United States Patent [19]

Groet et al.

[11] 4,201,841

[45] May 6, 1980

[54] PROCESS FOR PREPARING PHOTOGRAPHIC ELEMENTS EXHIBITING DIFFERENTIAL MICRO- AND MACRO-AREA RECORDING CHARACTERISTICS

[75] Inventors: Nicholas H. Groet; Jacque K. Lindsay, both of Rochester, N.Y.

[73] Assignee: Eastman Kodak Company, Rochester, N.Y.

[21] Appl. No.: 924,773

[22] Filed: Jul. 14, 1978

[51] Int. Cl.[2] ..... G03C 1/36

[52] U.S. Cl. ..... 430/567; 430/569; 430/570; 430/606

[58] Field of Search ..... 96/94 R, 107, 101, 22, 96/120

[56] References Cited

U.S. PATENT DOCUMENTS

| | | | |
|---|---|---|---|
| T904,022 | 11/1972 | Kurtz et al. | 96/109 |
| 3,615,499 | 10/1971 | Groet | 96/55 |
| 3,941,595 | 3/1976 | Ranz et al. | 96/107 |
| 4,082,553 | 4/1978 | Groet | 96/22 |

*Primary Examiner*—Won H. Louie, Jr.
*Attorney, Agent, or Firm*—Carl O. Thomas

[57] ABSTRACT

Disclosed herein is a process for forming photographic elements particularly useful in both macro- and micro-image reproduction. Such an element comprises a support having thereon one or more silver halide emulsion layers each primarily responsive to an identical portion of the visible spectrum, at least one of the layers containing silver haloiodide grains capable of forming a latent image upon imagewise exposure and a hydrophilic colloid suspending such grains, and at least one of the emulsion layers also having blended therein silver halide grains which are surface fogged as though exposed to imaging radiation of maximum intensity to render them spontaneously developable independent of imagewise exposure of the element.

9 Claims, 2 Drawing Figures

PROCESS FOR PREPARING PHOTOGRAPHIC ELEMENTS EXHIBITING DIFFERENTIAL MICRO- AND MACRO-AREA RECORDING CHARACTERISTICS

BACKGROUND OF THE INVENTION

1. Field of the Invention

The present invention relates to photographic processes for producing photographic elements. More particularly, the present invention is directed to photographic processes which produce photographic elements adapted to result in enhanced reproduction of both fine line and continuous tone images.

2. Description of the Prior Art

Photographic processes which produce the high contrast required for recording fine line copy are known, such as the processes which utilize commercially available microfilm. Microfilm typically comprises a photographic support having coated thereon one or more negative-working photographic silver halide emulsion layers. These emulsions are typically of high contrast (i.e., having a contrast greater than or equal to about 1.5) in order to satisfactorily record micro-image areas, such as fine line copy. These emulsions thereby provide adequate viewing and printing of micro-image information displayed on microfilm reader-printers.

Although the majority of the information recorded on microfilm is micro-image information, such as fine line copy, continuous tone and large area uniform tone (macro-image) information must also be copied. Unfortunately the high contrasts chosen for optimum micro-image recording are poorly suited to macro-image recording. Since conventional silver halide recording elements, such as micro-films, record both micro-images and macro-images at almost identical contrasts, the same high contrast that is optimum for micro-image recording must be tolerated for macro-image recording. A common result is microfilm records in which the fine-line copy appears sharp and well defined, but the continuous tone large area uniform tone areas appear too high in contrast and lack shadow detail.

U.S. Pat. No. 3,615,499 of Groet, issued Oct. 26, 1971, describes a photographic process which produces high contrast images of fine line copy and improved continuous tone images. The process comprises developing, with a primary aromatic color developing agent, an imagewise exposed photographic element comprising a support having coated thereon a photographic silver halide emulsion layer containing a development inhibitor releasing coupler, in the presence of a competing coupler which produces substantially no permanent dye in the emulsion layer and a silver halide solvent.

In Defensive Publication T904,022 of Kurz et al, it is disclosed that photographic images of increased sharpness can be obtained by incorporating physical development inhibitors in silver halide emulsions and developing them with silver solvents after exposure.

Surface fogged silver halide grains have been incorporated in silver halide emulsion layers of color photographic elements for the purpose of enhancing favorable interimage effects. Groet, in commonly assigned U.S. Application Ser. No. 688,445, filed May 20, 1976 now U.S. Pat. No. 4,082,553, issued Apr. 4, 1978, discloses a photographic element capable of producing multicolor dye images upon reversal processing. At least two silver halide emulsion layers are provided, each primarily responsive to a different region of the spectrum. In one of the emulsion layers the light-sensitive silver halide is silver haloiodide and in an adjacent emulsion layer surface fogged silver halide grains are blended. In a preferred form three silver halide emulsion layers are provided, each responsive to a different one of the blue, green and red regions of the spectrum and each containing light-sensitive silver haloiodide grains and surface fogged silver halide grains. It is, of course, essential that adjacent emulsion layers be responsive to a different portion of the spectrum in order for a favorable interimage effect to be obtained.

SUMMARY OF THE INVENTION

In one aspect, this invention is directed to a process of forming a photographic element capable of forming a micro-image of relatively high contrast and a macro-image of relatively low contrast, comprising a support, and coating onto the support one or more silver halide emulsion layers each primarily responsive to an identical portion of the visible spectrum upon imagewise exposure of the photographic element, and at least one of the emulsion layers containing silver haloiodide grains capable of forming a latent image upon imagewise exposure and a hydrophilic colloid suspending the grains, the improvement which comprises, in preparing at least one of the emulsion layers containing silver haloiodide grains, forming a blended silver halide emulsion by interspersing with the hydrophilic colloid suspended latent image-forming silver haloiodide grains in an amount sufficient to reduce macro-image contrast, additional silver halide grains which are surface fogged as though exposed to imaging radiation of maximum intensity to render them spontaneously developable independent of imagewise exposure of the photographic element.

It has been discovered quite unexpectedly that photographic elements prepared according to the process of this invention exhibit differential micro-image and macro-image recording characteristics. Specifically, it has been observed that the large area uniform and continuous tone contrast exhibited by the photographic elements is reduced appreciably, so that the optimum contrast for macro-image recording can be approached, without concurrently reducing the relatively high contrast desired for micro-image recording, such as line copy or fine detail in a continuous tone image.

It has been additionally observed that a greater density difference is obtainable between minimum density macro-image areas and minimum density micro-image areas. This can be observed, for example, in terms of greater legibility of printed line copy, such as black letters, appearing on a background of intermediate to high density when photographically printed from a film prepared according to this invention. To illustrate a practical application of this advantage, in microfilming a document, a black-and-white negative is frequently made of an original which is multicolored. The original can contain, for instance, black lettering on a colored background. Although the neutral density difference between the background and the lettering is not large, the eye can readily distinguish the lettering because of the color difference. When the original is microfilmed and then printed out in black-and-white, the lettering, using conventional black-and-white microfilm may be indistinct or even illegible. But, using black-and-white microfilm formed according to this invention, the density of the lettering can remain high while the density of the background is reduced sufficiently to allow the lettering to be readily read.

DESCRIPTION OF THE DRAWINGS

The present invention can be better appreciated by reference to the following detailed description considered in conjunction with the drawings, in which.

DESCRIPTION OF THE PREFERRED EMBODIMENTS

Figure 1:
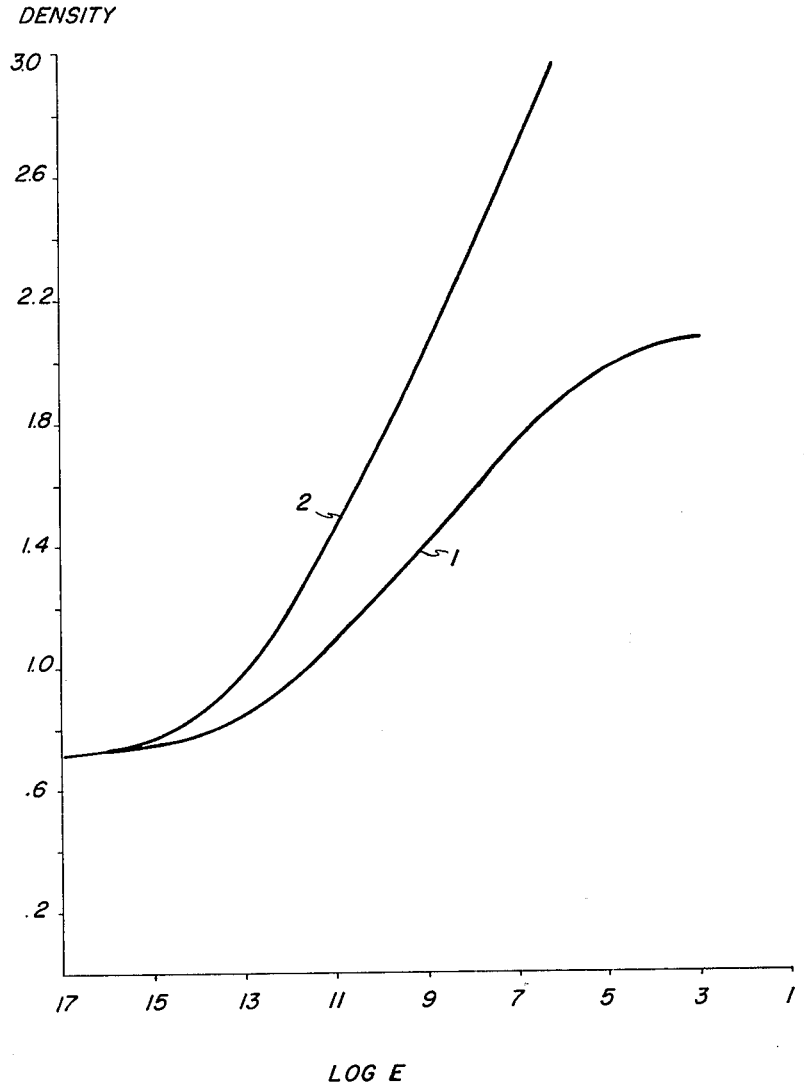
FIGS. 1 and 2 are plots of density as an ordinate versus log exposure as an abscissa in which Curves 1 and 3 are macro-image characteristic curves and Curves 2 and 4 are micro-image characteristic curves. The numerical scale in FIGS. 1 and 2 for the abscissa correspond to the numbers of the steps of the graduated test object through which exposure occurred, wherein Step 1 was of essentially 0 neutral density and each successive step is increased in density by a neutral density of 0.15.

The photographic elements of the present invention comprise one or more silver halide emulsion layers each primarily responsive to an identical portion of the visible spectrum upon imagewise exposure of the element. At least one of the emulsion layers contains silver haloiodide grains which are capable of forming a latent image upon exposure. The term "silver haloiodide" is employed in its art recognized usage, as is illustrated in U.S. Pat. Nos. 3,536,487 and 3,737,317. That is, as employed herein, the term "silver haloiodide" refers to silver halide grains, each of which contain a mixture of at least one other photographically useful halide and iodide. Silver haloiodides include silver chloroiodide, silver bromoiodide and silver chlorobromoiodide. Advantageously, the silver haloiodide contains from about 0.5 to about 10 mole percent and, preferably, from about 2 to about 6 mole percent iodide. The average grain size is preferably from about 0.05 to about 0.8 micron and most preferably from about 0.1 to about 0.5 micron.

The silver haloiodide grains are suspended in a hydrophilic colloid photographic vehicle. Suitable hydrophilic colloid vehicle materials which can be used alone or in combination include both naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like; and synthetic polymeric substances such as water soluble polyvinyl compounds like poly(vinylpyrrolidone) acrylamide polymers and the like.

Other synthetic polymeric vehicle compounds that can be used in combination with the hydrophilic colloid vehicle materials, include compounds such as dispersed vinyl compounds such as in latex form and particularly those which increase the dimensional stability of the photographic materials. Typical synthetic polymers include those described in Nottorf U.S. Pat. No. 3,142,568 issued July 28, 1964, White U.S. Pat. No. 3,193,386 issued July 6, 1965; Houck et al U.S. Pat. Nos. 3,062,674 issued Nov. 6, 1962 and 3,220,844 issued Nov. 30, 1965, Ream et al U.S. Pat. No. 3,287,289 issued Nov. 22, 1966 and Dykstra U.S. Pat. No. 3,411,911 issued Nov. 19, 1968. Other vehicle materials include those water-insoluble polymers of alkyl acrylates and methacrylates, acrylic acid, sulfoalkyl acrylates or methacrylates, those which have crosslinking sites which facilitate hardening or curing as described in Smith U.S. Pat. No. 3,488,708 issued Jan. 6, 1970, and those having recurring sulfobetaine units as described in Dykstra Canadian Pat. No. 744,054.

In addition to latent image-forming silver haloiodide grains and a hydrophilic colloid suspending these grains, the emulsion layer additionally contains, dispersed among the imaging silver haloiodide grains within the hydrophilic colloid, surface fogged silver halide grains which are spontaneously developable independent of imagewise exposure of the photographic element as though they had been exposed to imaging radiation of maximum intensity. The surface fogged grains can be formed prior to blending and coating by uniformly light exposing, introduction of reducing agents, chemically fogging with a conventional nucleating agent or by other conventional means. By surface fogging in this manner, silver halide grains which are initially capable of forming a surface latent image, the ability of these grains to form a latent image upon imagewise exposure of the photographic element is effectively destroyed. These surface fogged silver halide grains are spontaneously developable whether or not they are imagewise exposed and are to be distinguished from surface fogged internal image silver halide grains which develop only if not exposed and internally fogged silver halide grains which do not develop in a surface developer. The surface fogged silver halide grains are spontaneously developable to such an extent that they are indistinguishable in their development rates from the latent image-forming silver halide grains which have received maximum light during imagewise exposure. In other words, the surface fogged silver halide grains respond on development as though they had received an actinic exposure of the maximum intensity the photographic element could reasonably be expected to receive. Or, stated in terms of a characteristic curve, if the surface fogged silver halide grains comprised the entirety of the silver halide grains in the emulsion layer in which they are incorporated, they would produce a density on development falling at or near the shoulder of the characteristic curve for the emulsion layer, and this density would be substantially independent of imagewise exposure.

The surface fogged silver halide grains can be of any conventional photographic size distribution or crystalline form. In a preferred form the surface fogged silver halide grains have a mean grain diameter which is no greater than that of the latent image-forming silver halide grains with which they are associated. Generally it is preferred to employ relatively fine surface fogged silver halide grains, since finer grains provide more surface area than coarser grains for the same weight. In the present invention, it is preferred to employ surface fogged silver halide grains having a mean diameter of less than about 0.4 micron. It is further preferred to employ surface fogged silver halide grains which are before blending relatively monodispersed, most preferably satisfying the size-frequency ranges of Illingsworth U.S. Pat. No. 3,501,305. In many applications suitable fogged silver halide grains can be obtained merely by fogging, as described above, a portion of the light-sensitive silver halide emulsion which is to be used for imaging. The fogged portion of the emulsion is then blended with the remaining unfogged portion of the emulsion to achieve the desired proportion of fogged silver halide grains. The fogged silver halide grains can be formed from any conventional unfogged silver halide, including silver chloride, silver bromide, silver chlorobromide, silver chloroiodide, silver bromochloride, silver bromoiodide, silver chlorobromoiodide and the like.

Generally favorable results are obtained when as little as about 0.1 percent of the surface fogged silver halide grains, based on the total weight of silver halide in the layer, is present. As the concentration of the surface fogged silver halide grains is increased, the favorable effect of sharp, high contrast micro-images and sharper, lower contrast macro-images is enhanced until a level is reached where additional surface fogged silver halide grains do not produce a corresponding enhancement of macro-image sharpness. Advantageously the inclusion of from about 0.1 to about 20 percent by weight of surface fogged silver halide grains based on the total weight of silver halide in the emulsion layer and preferably from about 0.5 to about 10 percent surface fogged silver halide grains gives desirable results.

The emulsion layers generally contain from about 0.5 to about 2.0, and preferably from about 0.75 to about 1.5 g $Ag/m^2$ of support. The emulsions can comprise from about 0.5 to about 2.0 and preferably from about 0.75 to about 1.5 grams hydrophilic colloid per gram of silver or from about 0.25 to about 4.0 g colloid/$m^2$ of support.

The blended silver halide emulsions employed in forming the photographic elements can be free of spectral sensitizing dyes intended to alter their native spectral sensitivity or they can be spectrally sensitized by use of one or a combination of conventional spectral sensitizing dyes. In a preferred form the emulsions are panchromatically sensitized with a combination of spectral sensitizing dyes so that they are responsive throughout the visible spectrum. Orthochromatically sensitized silver halide emulsions are also contemplated for use. Conventional spectral sensitizing dyes suitable for use in the practice of this invention are disclosed, for example, in Paragraph XV, *Spectral sensitization, Product Licensing Index,* Volume 92, December 1971, Item 9232. To avoid equilibration loss of spectral sensitizing dye from the light-sensitive silver halide grains it is preferred that the dye be equally applied to both the light-sensitive and surface fogged silver halide grains by adding the dye to the silver halide emulsion after blending of the two silver halide grain populations or by similarly adding the dye to each grain population before blending.

In the preferred form the photographic elements formed according to this invention contain a single silver halide emulsion layer. If more than one silver halide emulsion layer is present, each of the silver halide emulsion layers is primarily responsive to an identical portion of the visible spectrum upon imagewise exposure. Stated in another way, the silver halide emulsion layers lack sufficient spectral sensitivity differences to produce multicolor dye images such as those obtained by color photographic elements. Stated in still another way, the photographic elements are black-and-white photographic elements. In the preferred mode of use they produce generally coextensive silver images in each of the emulsion layers upon imagewise exposure and processing. Where dye images are produced, they also are substantially coextensive in each of the emulsion layers. Some slight variation in native blue sensitivity may exist from one emulsion layer to the next where the light-sensitive grains differ in halide composition; however, such variations in spectral sensitivity are minor as compared with the differential spectral sensitization of silver halide emulsion layers in color photographic elements intended to form multicolor dye images.

It is specifically preferred that the latent image-forming silver halide grains be protected against fogging and against loss of sensitivity during keeping. Since the surface fogged silver halide grains are fogged by light exposure or chemical means before blending with the latent image-forming silver halide grains, the presence of an antifoggant and surface fogged silver halide grains in a single emulsion layer is not incompatible. Conventional antifoggants and stabilizers are preferably incorporated in the emulsion layers for this purpose. Exemplary useful antifoggants and stabilizers, each used alone, or in combination, include the thiazolium salts described in Brooker et al U.S. Pat. No. 2,131,038 and Allen et al U.S. Pat. No. 2,694,716; the azaindenes described in Piper U.S. Pat. No. 2,886,437 and Heimbach et al U.S. Pat. No. 2,444,605; the mercury salts as described in Allen et al U.S. Pat. No. 2,728,663; the urazoles described in Anderson et al U.S. Pat. No. 3,287,135; the sulfocatechols described in Kennard et al U.S. Pat. No. 3,236,652; the oximes described in Carroll et al British Pat. No. 623,448; nitron; nitroindazoles; the mercaptotetrazoles described in Kendall et al U.S. Pat. No. 2,403,927, Kennard et al U.S. Pat. No. 3,266,897 and Luckey et al U.S. Pat. No. 3,397,987; the polyvalent metal salts described in Jones U.S. Pat. No. 2,839,405; the thiuronium salts described in Herz U.S. Pat. No. 3,220,839 and the palladium, platinum and gold salts described in Trivelli et al U.S. Pat. No. 2,566,263 and Yutzy U.S. Pat. No. 2,597,915.

In addition to at least one emulsion layer the photographic elements perpared according to this invention include a conventional photographic support. Typical supports include cellulose nitrate film, cellulose acetate film, poly(ethylene terephthalate)film, polycarbonate film and related films or resinous materials, as well as glass, paper, metal and the like. In the preferred form the photographic elements include a transparent film support. Where more than one silver halide emulsion layer is present in the element, the emulsion layers can be coated on the same major surface of the support or on opposite major surfaces.

In addition to the features described above, the photographic elements and their preparation can include numerous additional features well known to those skilled in the photographic arts. For example, to obtain the desired sensitometric characteristics, such as contrast, sensitivity and the like, the silver haloiodide emulsion to be blended with the surface fogged silver halide grains can itself be the product of blending with other conventional silver halide emulsions, such as monodispersed or polydispersed silver bromide, silver chloride or silver chlorobromide emulsions, provided the iodide content of the resulting blended haloiodide emulsion remains at least about 0.5 mole percent iodide, preferably from 2 to 6 mole percent iodide. Each of the silver halide emulsions employed in blending can be prepared according to well known precipitation techniques, as illustrated by Paragraph I, Emulsion types. The emulsions can be washed, as illustrated by Paragraph II, Emulsion washing. The emulsions can be chemically sensitized, as illustrated by Paragraph III, Chemical sensitization. The emulsions can contain incorporated developing agents, as illustrated by Paragraph VI, Developing agents. The photographic elements can contain overcoat layers, subbing layers and interlayers in addition to the emulsion layers, such layers preferably comprising hydrophilic colloid vehicles similar to those described above in connection with the silver halide emulsions. The emulsion and other hydrophilic colloid layers of the photographic elements can be hardened, as illustrated by Paragraph VII, Hardeners. The elements can contain antistatic layers, as illustrated by Paragraph IX, Antistatic layers. The elements can contain plasticizers and lubricants and/or coating aids, as illustrated by Paragraphs XI, Plasticizers and lubricants and XII, Coating aids. The layers of the elements, particularly the outer layers, can contain matting agents, as illustrated by Paragraph XIII, Matting agents. The photographic elements can contain absorbing and filter dyes, particularly in a separate antihalation layer coated beneath or on a support surface opposite the emulsion layer or layers, as illustrated by Paragraph XVI, Absorbing and filter dyes. The various addenda can be added to the emulson and other layers employing conventional techniques, as illustrated by Paragraph XVII, Methods of addition. The layers can be coated by conventional techniques, as illustrated by Paragraph XVIII, Coating procedures. Each of the numbered paragraphs identified above form a part of Product Licensing Index, Item 9232, cited above. Product Licensing Index and Research Disclosure are published by Industrial Opportunities Ltd., Homewell, Havant Hampshire, P09 1EF, UK.

The photographic elements can be imagewise exposed to actinic radiation in any conventional manner. They can be monochromatically, orthochromatically or panchromatically exposed. They can be exposed with visible light, ultraviolet light or infrared radiation. In a preferred form the photographic elements are panchromatically sensitized and exposed with a white light source.

The photographic elements can be processed following exposure to form a visible image by associating the silver halide with an aqueous alkaline medium in the presence of a developing agent contained in the medium or the element. Processing formulations and techniques are described in L. F. Mason, *Photographic Processing Chemistry*, Focal Press, London, 1966; *Processing Chemicals and Formulas*, Publication J-1, Eastman Kodak Company, 1973; Photo-Lab Index, Morgan and Morgan, Inc., Dobbs Ferry, New York, 1977, and *Neblette's Handbook of Photography and Reprography - Materials, Processes and Systems*, VanNostrand Reinhold Company, 7th Ed., 1977.

Included among the processing methods are web processing, as illustrated by Tregillus et al U.S. Pat. No. 3,179,517; stabilization processing, as illustrated by Herz et al U.S. Pat. No. 3,220,839, Cole U.S. Pat. No. 3,615,511, Shipton et al U.K. Pat. No. 1,258,906 and Haist et al U.S. Pat. No. 3,647,453; monobath processing as described in Haist, Monobath Manual, Morgan and Morgan, Inc., 1966, Schuler U.S. Pat. No. 3,240,603, Haist et al U.S. Pat. Nos. 3,615,513 and 3,628,955 and Price U.S. Pat. No. 3,723,126; infectious development, as illustrated by Milton U.S. Pat. Nos. 3,294,537, 3,600,174, 3,615,519 and 3,615,524, Whiteley U.S. Pat. No. 3,516,830, Drago U.S. Pat. No. 3,615,488, Salesin et al U.S. Pat. No. 3,625,689, Illingsworth U.S. Pat. No. 3,632,340, Salesin U.K. Pat. No. 1,273,030 and Salesin U.S. Pat. No. 3,708,303; hardening development, as illustrated by Allen et al U.S. Pat. No. 3,232,761; roller transport processing, as illustrated by Russell et al U.S. Pat. Nos. 3,025,779 and 3,515,556, Masseth U.S. Pat. No. 3,573,914, Taber U.S. Pat. No. 3,647,459 and Rees et al U.K. Pat. No. 1,269,268; alkaline vapor processing, as illustrated by Patent Licensing Index, Vol. 97, May 1972, Item 9711, Goffe et al U.S. Pat. No. 3,816,136 and King U.S. Pat. No. 3,985,564; metal ion development as illustrated by Price, *Photographic Science and Engineering*, Vol. 19, Number 5, 1975, pp. 283-287 and Vought, Research Disclosure, Vol. 150, October 1976, Item 15034; reversal processing, as illustrated by Henn et al U.S. Pat. No. 3,576,633; and surface application processing, as illustrated by Kitze U.S. Pat. No. 3,418,132.

Development of the elements of the present invention after exposure is preferably accomplished with conventional black-and-white developers containing a silver halide solvent. Conventional types and quantities of silver halide solvents can be employed, including thioethers; alkali thiosulfates, thiocyanates and cyanides; thiourea; thiocyanamine; ammonium hydroxide and the like. For example, it is preferred to employ thioether or alkali metal or ammonium thiocyante silver halide solvents in concentrations of from about 0.25 to 10 grams/liter of developer solution, optimally at concentrations of from 1 to 3 grams/liter of developer solution. Useful thioether silver halide solvents are disclosed in McBride U.S. Pat. No. 3,271,157; useful thiocyanate silver halide solvents are disclosed in Nietz et al U.S. Pat. No. 2,222,264, Lowe et al U.S. Pat. No. 2,448,534 and Illingsworth U.S. Pat. No. 3,320,069.

As used throughout this application, a micro-image generally refers to an image of less than 10 microns in width, such as line print and the like, and a macro-image generally refers to an image greater than 1000 microns in width. Relatively high contrast is defined as a contrast greater than or equal to about 1.5 and relatively low contrast is defined as a contrast less than 1.5.

The present invention is further illustrated by the following examples.

EXAMPLE 1

A control photographic element was prepared by coating a sulfur and gold sensitized, 0.2 micron, monodispersed, panchromatically sensitized silver bromoiodide emulsion (3.43 mole percent iodide) at 1.20 g $Ag/m^2$ and 1.20 g gelatin/$m^2$ on a cellulose acetate film support provided with an antihalation undercoat. A hardened gelatin layer was coated as an overcoat on the emulsion layer at 0.89 g gelatin/$m^2$.

This element, when dried, was exposed for 0.10 second to tungsten light (500 W., 2850° K., Daylight V filter and Wratten 3 filter) through a graduated density step tablet and then processed for 2 minutes, 15 seconds in Kodak DK-50 developer mixed with 2 g NaSCN/liter at 30° C. The sodium thiocyanate is silver halide solvent. Table I below lists the sensitometric data obtained from this processed element.

Another element (Example 1) was prepared according to the present invention similar to the control element, except that the emulsion layer also contained 0.01 g/$m^2$ of 0.07 micron, spontaneously developable, fogged silver bromide grains. The dried element was developed and processed as for the control element and the results are listed in Table I.

Table I

| Reference | Relative Speed* | $\gamma$** | $D_{min}$ | $D_{max}$ |
|---|---|---|---|---|
| Control | 200 | 1.5 | 0.28 | 1.88 |
| Example 1 | 148 | 1.0 | 0.72 | 2.08 |

*Relative speed measured at 0.3 above $D_{min}$.
**$\gamma$ = Contrast

EXAMPLE 2

To compare the macro-imaging and micro-imaging characteristics of the elements of the invention, Example 1 was repeated twice, but with a modified step tablet in each instance. The step tablets were films of high density so as to be essentially opaque or non-transmissive to the exposing light. Spaced on the supports by a separating distance sufficient to eliminate adjacency effects were areas of differing density wherein the density differences between successive areas were similar to those of the step tablet employed in Example 1. In one instance the spaced areas were macro-imaging areas of 1000 microns in width. In the second instance the areas were micro-imaging areas of 10 microns in width.

Macro-imaging gave results essentially similar to those of Example 1. The characteristic curve for the macro-imaging areas is Curve 1 in FIG. 1. The characteristic curve for the micro-imaging areas is Curve 2 in FIG. 1.

EXAMPLE 3

Example 2 was repeated, except that instead of the step tablet having the micro-imaging and macro-imaging areas of stepped density on an otherwise essentially opaque film these areas were on an essentially transparent film.

Macro-imaging gave results essentially similar to those of Example 1. The characteristic curve for the macro-imaging areas is Curve 3 in FIG. 2, which is essentially identical to Curve 1 in FIG. 1. The characteristic curve for the micro-imaging areas is Curve 4 in FIG. 2.

Figure 2:
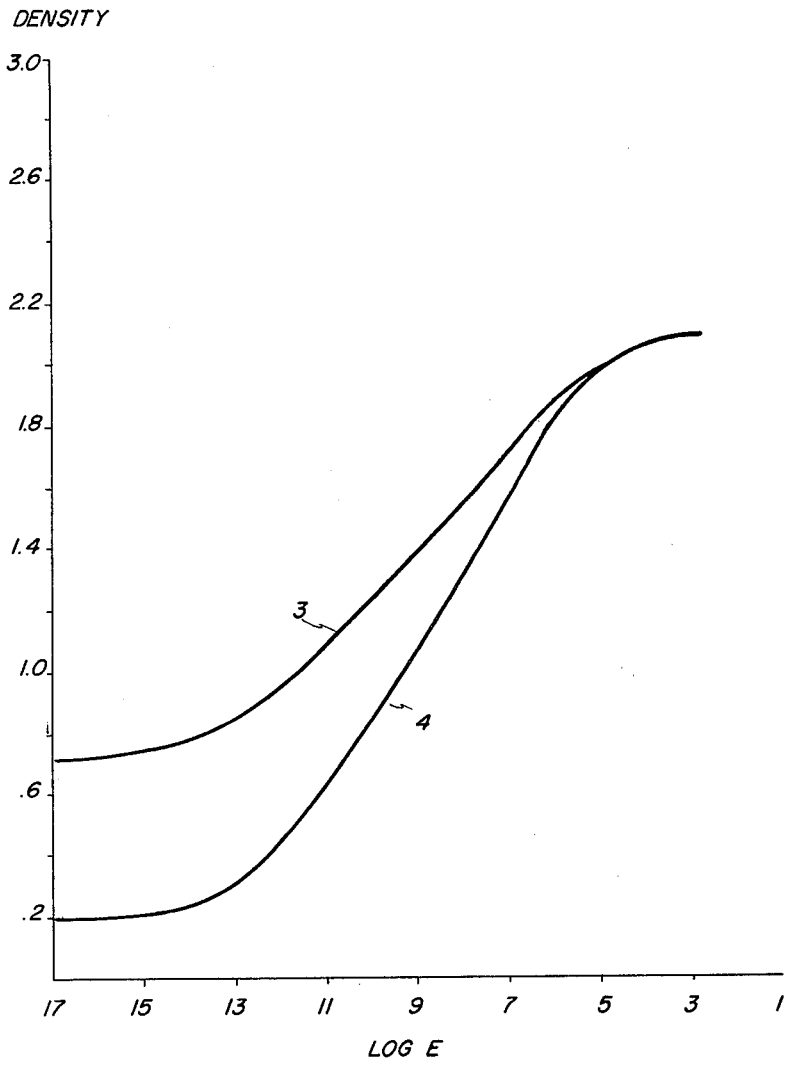

The results obtainable in both macro-imaging areas and micro-imaging areas can be readily appreciated by reference to Table I, FIG. 1 and FIG. 2. It can be seen by reference to Table I that the inclusion of fogged silver halide grains in the emulsion had the effect of changing the photographic element from a high contrast photographic element to a low contrast photographic element upon macro-imaging exposure. Comparing also Curves 1 and 3 in FIGS. 1 and 2 it can be seen that the characteristic of the macro-imaging areas is substantially unaffected by the exposure and development of adjacent areas of the film.

Comparing Curves 1 and 2 it can be seen that the micro-imaging curve is of higher contrast and higher maximum density than the macro-imaging curve, although both curves have a common minimum density. The contrast of the micro-imaging curve is 2.0, which was not only higher than the contrast 1.0 of the micro-imaging curve, but which is also higher than the 1.5 contrast of the control in Table I. When no silver halide solvent is present in the developer and no fogged silver halide grains are included in the photographic element emulsion layer, the micro-imaging and macro-imaging characteristic curves are substantially identical. The presence of the silver halide solvent in the developer alone can cause a significant reduction in the contrast of the macro-imaging curve, but the wide divergence of the micro-imaging and macro-imaging curves requires the inclusion of fogged silver halide.

Comparing FIGS. 1 and 2 it can be seen that Curve 3 for the macro-imaging areas is unaffected by silver halide exposure and development in surrounding areas, but micro-imaging characteristic Curve 4 is displaced downwardly as compared to micro-imaging characteristic Curve 2. It is a very significant advantage of this invention that the minimum density level of the micro-imaging areas is sharply reduced. In comparing the control in Table I with the minimum density of Curve 4 it can be seen that the minimum density of the micro-imaging area is 0.2 whereas the minimum density of the control is 0.28. If the photographic element is used as a negative for producing a positive print, it can be appreciated that the low minimum density of the micro-imaging areas can be seen as maximum density micro-image areas which are of increased density in relation to adjacent high density macro-image areas in the print image. This can have a very advantageous effect of allowing a printed text to exhibit an enhanced density difference between the text characters and the background areas when the background is of an intermediate or higher density. Curve 4 is of slightly lower contrast than Curve 2, but it still exhibits a significantly higher contrast than Curve 3.

The invention has been described with particular reference to preferred embodiments thereof but it will be understood that variations and modifications can be effected within the spirit and scope of the invention.

We claim:

1. In a process of forming a photographic element capable of forming a micro-image of relatively high contrast and a macro-image of relatively low contrast comprising coating onto a support one or more silver halide emulsion layers, each of the silver halide emulsion layers present in the photographic element being primarily responsive to an identical portion of the visible spectrum upon imagewise exposure of the photographic element, and at least one of the emulsion layers containing silver haloiodide grains capable of forming a latent image upon imagewise exposure and a hydrophilic colloid suspending the grains, the improvement comprising in preparing at least one of the emulsion layers containing silver haloiodide grains, forming a blended silver halide emulsion by interspersing with the hydrophilic colloid suspended latent image-forming silver haloiodide grains additional silver halide grains which are surface fogged as though exposed to imaging radiation of maximum intensity to render them spontaneously developable independent of imagewise exposure of the photographic element, said additional, surface fogged silver halide grains being interspersed in a concentration of 0.1 to 20 percent, based on the total weight of silver halide.

2. An improved process according to claim 1 wherein the photographic element is formed by coating a single silver halide emulsion onto the support.

3. An improved process according to claim 1 wherein the one or more silver halide emulsion layers are panchromatically sensitized.

4. An improved process according to claim 1 wherein the surface fogged silver halide grains are present in an amount sufficient to increase the difference in contrast between micro-image and macro-images.

5. An improved process according to claim 1 wherein the fogged silver halide grains are present in the one or more silver halide emulsion layers in a concentration of from 0.5 to 10 percent based on the total weight of silver halide.

6. An improved process according to claim 1 or claim 10 wherein the haloiodide grains are from about 0.5 to 10 mole percent iodide based on total halide.

7. An improved process according to claim 6 wherein the haloiodide grains are from about 2 to 6 mole percent iodide based on total halide.

8. An improved process according to claim 1 wherein the surface fogged silver halide grains are before blending relatively monodispersed and have a mean grain diameter less than about 0.4 micron.

9. In a process of forming a photographic element capable of forming a micro-image of relatively high contrast and a macro-image of relatively low contrast comprising coating onto the support a single panchromatically spectrally sensitized silver halide emulsion layer comprised of a hydrophilic colloid and silver haloiodide grains capable of forming a latent image upon imagewise exposure, the improvement comprising forming the silver halide emulsion by blending with an emulsion containing the silver haloiodide grains and hydrophilic colloid a monodispersed silver halide emulsion comprised of hydrophilic colloid and silver halide grains of less than 0.4 micron in mean diameter which are surface fogged as though exposed to imaging radiation of maximum intensity to render them spontaneously developable independent of imaging exposure of the photographic element, said surface fogged silver halide grains being blended in a concentration of from 0.5 to 10 percent be weight, based on the total weight of the silver halide.

* * * * *